US008259538B2

(12) United States Patent
Petremand et al.

(10) Patent No.: US 8,259,538 B2
(45) Date of Patent: Sep. 4, 2012

(54) LOCKING MECHANISM FOR TIMEPIECE DRIVE MODULE

(75) Inventors: Yves Petremand, Yverdon (CH); Nicolas Golay, Neuchâtel (CH); Martin Bisig, Zuchwil (CH); Lionel Paratte, Neuchâtel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 502 days.

(21) Appl. No.: 12/579,601

(22) Filed: Oct. 15, 2009

(65) Prior Publication Data

US 2010/0097900 A1 Apr. 22, 2010

(30) Foreign Application Priority Data

Oct. 16, 2008 (EP) ..... 08166740

(51) Int. Cl.
*G04B 1/00* (2006.01)

(52) U.S. Cl. ..... 368/160

(58) Field of Classification Search ..... 368/160
See application file for complete search history.

(56) References Cited

U.S. PATENT DOCUMENTS 4,271,493 A * 6/1981 Tamaru et al. ..... 368/28
4,647,218 A 3/1987 Wuthrich
5,959,376 A 9/1999 Allen
6,211,599 B1 4/2001 Barnes et al.
6,744,696 B2 * 6/2004 Vernay et al. ..... 368/37
7,447,119 B2 11/2008 Paratte et al.
2008/0111445 A1 5/2008 Paratte et al.

FOREIGN PATENT DOCUMENTS

EP 1 921 520 5/2008
WO 2006/097516 9/2006

OTHER PUBLICATIONS

European Search Report issued in corresponding application No. EP 08 16 6740, completed Jan. 16, 2009.

* cited by examiner

*Primary Examiner* — Renee Luebke
*Assistant Examiner* — Jason Collins
(74) *Attorney, Agent, or Firm* — Griffin & Szipl, P.C.

(57) ABSTRACT

A device for the locking and unitary incrementation of a drive module (1) for a timepiece gear train is provided. The module (1) includes an actuator (2) fitted with an active click (5) cooperating with a toothed wheel (7), and the device includes a first (8) and a second (9) finger cooperating with the toothed wheel (7). The device is characterized in that the first finger (8) entirely locks the rotation of the toothed wheel (7) when it is engaged in one of the teeth of the toothed wheel (7); and in that the second finger (9) is arranged between a first (10) and a second (11) stop member, wherein the space between the stop members (10, 11) limits the angular travel of the toothed wheel (7) when the second finger (9) is engaged in one of the teeth of the toothed wheel (7).

12 Claims, 5 Drawing Sheets

LOCKING MECHANISM FOR TIMEPIECE DRIVE MODULE

This application claims priority from European Patent Application No. 08166740.4 filed Oct. 16, 2008, the entire disclosure of which is incorporated herein by reference.

FIELD OF THE INVENTION

The present invention concerns a locking mechanism for a timepiece drive module. The invention is particularly suited to electromechanical micromotors for wristwatches.

BACKGROUND OF THE INVENTION

Stepping motors are well known for converting electrical pulses into rotating mechanical movement. The first stepping motor was invented in 1936 by Mr Lavet for the clock and watch making industry; and since then these motors are found driving the movement in most quartz watches with hands. This type of motor is also commonly found in all devices where one wishes to control speed or position.

"Lavet" motors have permanent magnets that can generate stable positions between electrical pulses. The permanent torque thus exerted on the rotor, i.e. the rotating part of the motor, is supposed to prevent any inadvertent movement thereof, even when the watch undergoes shocks. The purpose of the permanent torque, which is generally selected to be considerably greater than the motor torque, is also to prevent any incrementation of more than one step simultaneously. These positioning torques do not, however, completely lock or incrementally index the meshed wheels; click systems have consequently been proposed for cooperating with these motors to improve the hold and lock functions, as for example in U.S. Pat. No. 4,647,218. In this Patent, a Lavet motor drives a wheel in rotation through 180 degrees with each electrical pulse, i.e. every minute; the wheel is fitted at two diametrically opposite ends with spigots, which engage in successive radial slots in the minute wheel. Thus, between each pulse, the two spigots are engaged in two successive radial slots of the minute wheel and prevent any possible movement thereof.

Now, other types of stepping motor are available, for example the micromechanical electromotor disclosed in EP Patent No. 1921520 by the Applicant, which includes a linear actuator fitted with an active click for driving the wheel in rotation, and a passive click for preventing the rotor from rotating in the opposite direction when the actuator returns during its oscillations. For this motor, the same locking and unitary incrementation functions would also be desirable. However, it is clear that the click mechanism described above, specific to a Lavet motor, is not suitable.

BRIEF SUMMARY OF THE INVENTION

It is an object of the present invention to propose a new mechanism that locks a meshed wheel in stable indexing positions and, in parallel, prevents any incrementation thereof by more than one step simultaneously.

It is another object of the present invention to propose a locking mechanism that can be applied to any type of stepping motor, and not solely to a "Lavet" type motor.

These objects are achieved in particular owing to a device for the locking and unitary incrementation of a drive module 1 for a timepiece gear train, including an actuator 2, fitted with an active click 5 cooperating with a toothed wheel 7. Device 1 includes a first finger 8 and second finger 9 cooperating with toothed wheel 7, and is characterized in that:

first finger 8 entirely locks the rotation of said toothed wheel 7 when it is engaged in one of the teeth of said toothed wheel 7; and second finger 9 is arranged between a first stop member 10 and a second stop member 11, and the space between stop members 10 and 11 limits the angular travel of toothed wheel 7 when said second finger 9 is engaged in one of the teeth of said toothed wheel 7.

These objects are also achieved by a locking method using the device according to the main claim and including the steps of:

(A) lowering first finger 8 and releasing the toothed wheel 7;

(B) driving toothed wheel 7 in rotation via said active click 5 of said actuator;

(C) raising first finger 8 and engaging it in one of the teeth of toothed wheel 7;

(D) releasing and returning said active click 5 of actuator 2;

(E) releasing and returning the second finger against the first stop member 10;

(F) raising the second finger 9 and engaging it in one of the teeth of said toothed wheel 7.

One advantage of the proposed solution is that it is can be applied or associated with any type of stepping motor, including for example, regulating members for mechanical watches, and potentially any type of timepiece drive module.

Another advantage of the proposed solution is that it no longer requires permanent magnets for stabilising the idle or rest position of gear trains driven by the motor.

An additional advantage of the proposed solution is that an electromechanical stepping motor no longer needs passive clicks to prevent the rotor from rotating in the opposite direction when the actuator returns during its oscillations.

Moreover, the proposed locking solution fundamentally differs from the locking system applied to the Lavet motor in that the power consumption required is not linked to the value of the maximum motor torque. An important advantage of the proposed solution is consequently that the power consumption of the locking system is potentially considerably less than that of the motor itself.

BRIEF DESCRIPTION OF THE DRAWINGS

Example implementations of the invention are indicated in the description and illustrated by the annexed Figures, in which.

EXAMPLE EMBODIMENTS OF THE INVENTION

Figure 1:
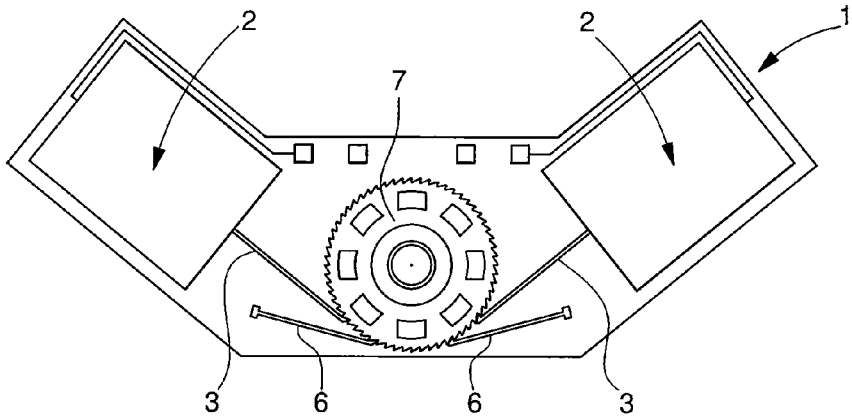
PRIOR ART Fig. 1
FIG. 1 illustrates a top view of a known stepping motor of the prior art, which will preferably be associated with the locking mechanism according to the invention.

FIG. 1 illustrates a drive module 1, for meshing with a timepiece wheel, including a known type of electromechanical stepping micromotor. The micromotor is formed of actuators 2, which include mobile styli 3 that drive a rotor in rotation via active clicks 5, which cooperate with toothed wheel 7 of the rotor. Given their active function of driving the rotor 5, the term "motor" actuator is also often used for actuators 2. This cooperation between toothed wheel 7 and the clicks, and the mechanism for driving the rotor sequentially in rotation are precisely illustrated in detail in FIG. 1*b*, which is an enlargement of FIG. 1, showing toothed wheel 7, at 5 o'clock in the plane of the motor.

In FIG. 1, actuator 2 is formed of two overall symmetrical parts, the first part including an active thrust click and the second part including an active traction part so as to improve the motor yield by exerting a higher torque. However, those skilled in the art will understand that a single thrust click and a single traction click are enough to drive the rotor in rotation. According to the advantageous embodiment shown, each actuator 2 is associated with a passive click 6, held elastically meshed with toothed wheel 7 so as to ensure precise angular positioning during drive phases, when styli 3 are being moved, and also to form a locking mechanism for toothed wheel 7, to prevent any backward movement thereof.

Figure 1B:
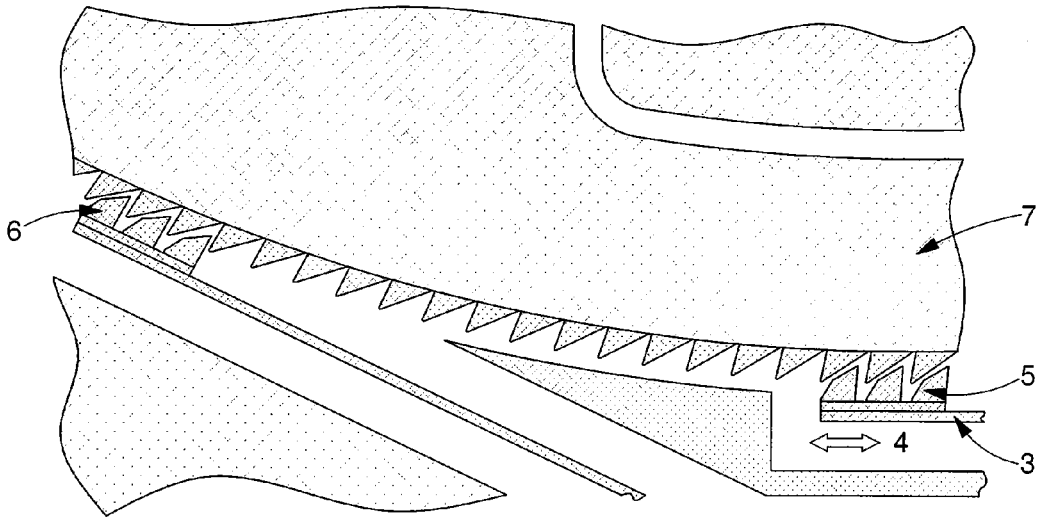
PRIOR ART Fig. 1b
FIG. 1*b* illustrates a cross-section, along the plane of the motor, of the detailed actuation of the toothed wheel of the rotor with the active and passive clicks.

FIG. 1*b* illustrates the drive and indexing mechanism for the stepping motor of FIG. 1, where a single passive click 6 and a single active click are shown. The active click 5, located at the end of the stylus, has oscillating movements in the tangential direction 4 to toothed wheel 7. The indentations of toothed wheel 7 tend to drive it in a movement in the anti-clockwise rotational direction during traction movements of stylus 3, while each tooth of the associated passive click 6 then gives indexing positions for rotating the toothed wheel, typically corresponding to one motor step. Moreover, during the return movement of stylus 3 in the same tangential direction 4 to toothed wheel 7, but in the opposite direction, passive click 6 prevents active click 5 from driving toothed wheel 7 in the opposite direction and from maintaining the angular position of toothed wheel 7 between each step. The locking and indexing mechanism described does not, however, prevent any undesirable acceleration of toothed wheel 7 anti-clockwise, such as, for example, in the event of too great a motor torque exerted by the active click(s) 5 if the amplitude of the electrical pulses generated by actuators 2 is too large, or even between motor steps if the watchcase containing the electromechanical motor undergoes shocks.

FIGS. 2 to 7 illustrate a preferred embodiment of the locking and indexing mechanism according to the invention, which overcomes these deficiencies of the prior art. They all show cross-sections in the rotational plane of a toothed wheel 7, driven by an active click 5, which engages in the teeth of toothed wheel 7 and moves linearly via oscillating movements along a tangential direction to toothed wheel 7 at the gearing level, and the locking device, formed of two distinct locking fingers 8 and 9, in various positions depending upon the state of the mechanism. According to the preferred embodiment illustrated, the first locking finger 8 is housed between two stop elements 15, 16, such that it is guided to have only vertical movements, having thus only one degree of freedom in translation. According to an alternative embodiment, this degree of freedom could however also be in rotation. The function of the first finger is to check any rotational movement of the toothed wheel when it is engaged in one of its teeth. The second locking finger 9 is arranged between two stop members 10 and 11, such that it limits the angular travel of the toothed wheel when the finger is engaged in one of the teeth of the wheel. According to the preferred embodiment of the invention shown, the space between stop members 10, 11 limits the angular travel of toothed wheel 7 to the movement of a single tooth, thus corresponding to one motor step. References to stop members 10, 11, and to the stop elements will be illustrated in all of the following FIGS. 3 to 7, which describe the movements of the fingers during various locking steps, but they will not, however, be systematically mentioned again in the description.

Figure 2:
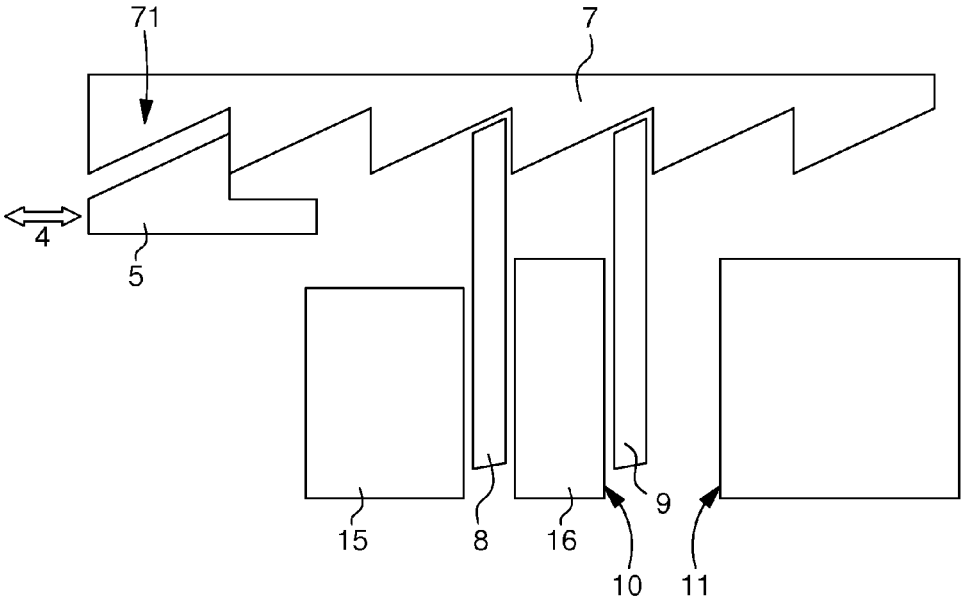
FIG. 2 illustrates a cross-section of a locking device according to a preferred embodiment of the invention, while idle before a motor step.

FIG. 2 illustrates the locking device according to the invention in an idle or rest state, before a motor step. In this state, the two locking fingers 8 and 9 are raised, and housed in two consecutive teeth of toothed wheel 7. The second locking finger 9 is also housed against the first stop member 10. When the system is in this state, click 5 is engaged in one of teeth 71 of toothed wheel 7, and moves in linear movements of oscillation along arrow 4 (NB: the mobile stylus, shown in FIGS. 1 and 1*b*, is no longer shown in this Figure or in the following Figures since it is not necessary for comprehension of the locking mechanism described below). Reference to this tooth 71 meshed by active click 5 is illustrated in all of the following FIGS. 3 to 7, but it will not, however, be systematically mentioned again in the description.

Figure 3:
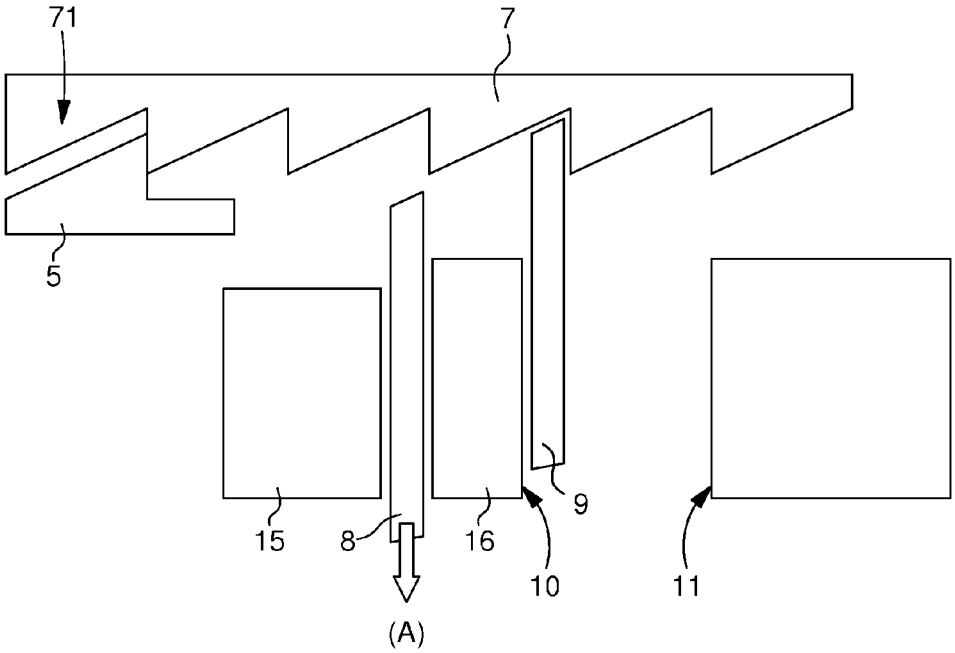
FIG. 3 illustrates a cross-section of a locking device according to a preferred embodiment of the invention during the step of lowering the first locking finger.

FIG. 3 illustrates the locking device during the step (arrow A) of lowering first locking finger 9. According to the preferred embodiment shown, it can be observed that the only degree of freedom of first locking finger 8 is in translation in a radius of toothed wheel 7, i.e. perpendicular to the movement of the actuator and active click 5, as will be seen in the following Figures. Once the finger has been lowered, toothed wheel 7 can be driven in rotation. However, when the system is in this state, the second locking finger 9 is still housed against first stop member 10, although it has a degree of freedom in translation between the two stop members 10 and 11.

Figure 4:
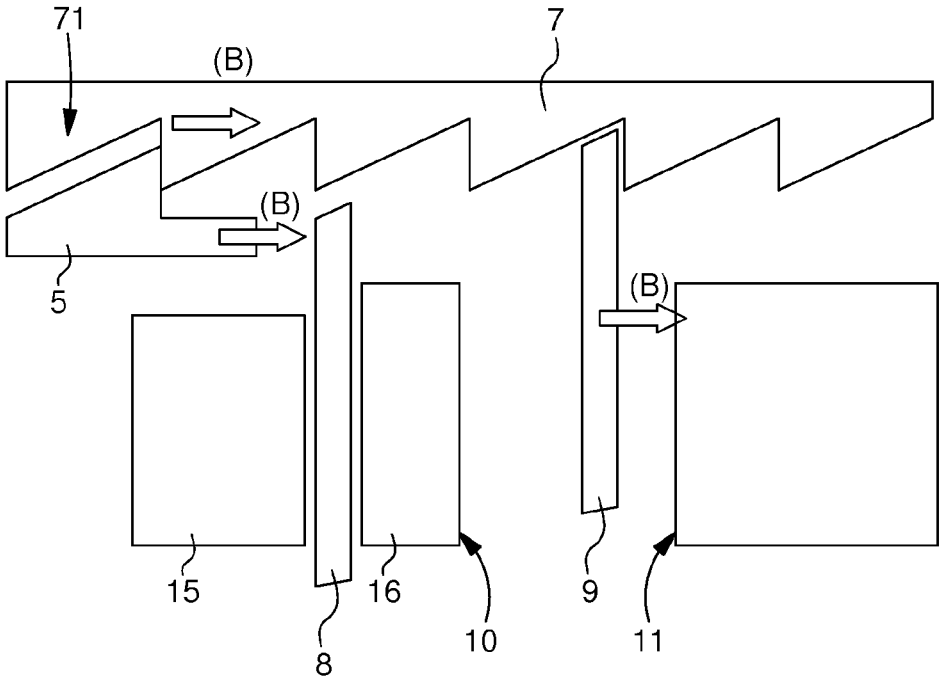
FIG. 4 illustrates a cross-section of a locking device according to a preferred embodiment of the invention during a motor step.

FIG. 4 illustrates the locking device according to the invention during a motor step, i.e. when toothed wheel 7 is being driven in rotation by active click 5 (step B, illustrated by the corresponding arrows B). The rotation of toothed wheel 7, in one of the teeth of which locking finger 9 is engaged, thus drives finger 9 in the same movement of translation as that of the click, along the arrow (B), in a tangential direction to the wheel and the direction that corresponds to one of its two degrees of freedom. Toothed wheel 7 stops as soon as the second finger 9 is positioned against the second stop member 11, which prevents any additional movement of the toothed wheel.

Figure 5:
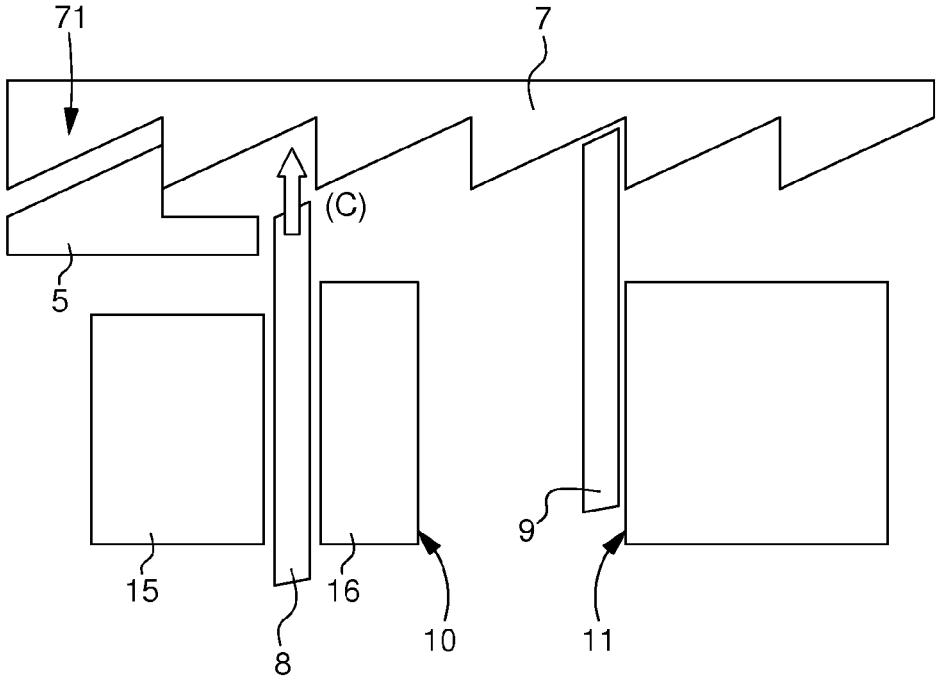
FIG. 5 illustrates a cross-section of a locking device according to a preferred embodiment of the invention when the second locking finger is being stopped.

FIG. 5 illustrates the locking device according to the invention, in the state where the second finger 9 is locked against stop member 11. The arrow (C) illustrates the step of lifting the first locking finger 8, which then engages in one of the teeth of the toothed wheel and thus checks any movement of toothed wheel 7, even in the opposite direction to that in which it was being actuated until that time, i.e. in the clockwise direction for the embodiment described. Once this step has finished, the device will thus again be in a stable state, preventing any rotational movement of the toothed wheel, but this time with both fingers 8, 9 separated by two teeth, unlike in FIG. 2, where the two fingers were housed in two consecutive teeth of the wheel. Thus, in the illustrated embodiment, the angular travel of toothed wheel 7 corresponds, at most, to one tooth of toothed wheel 7.

Figure 6:
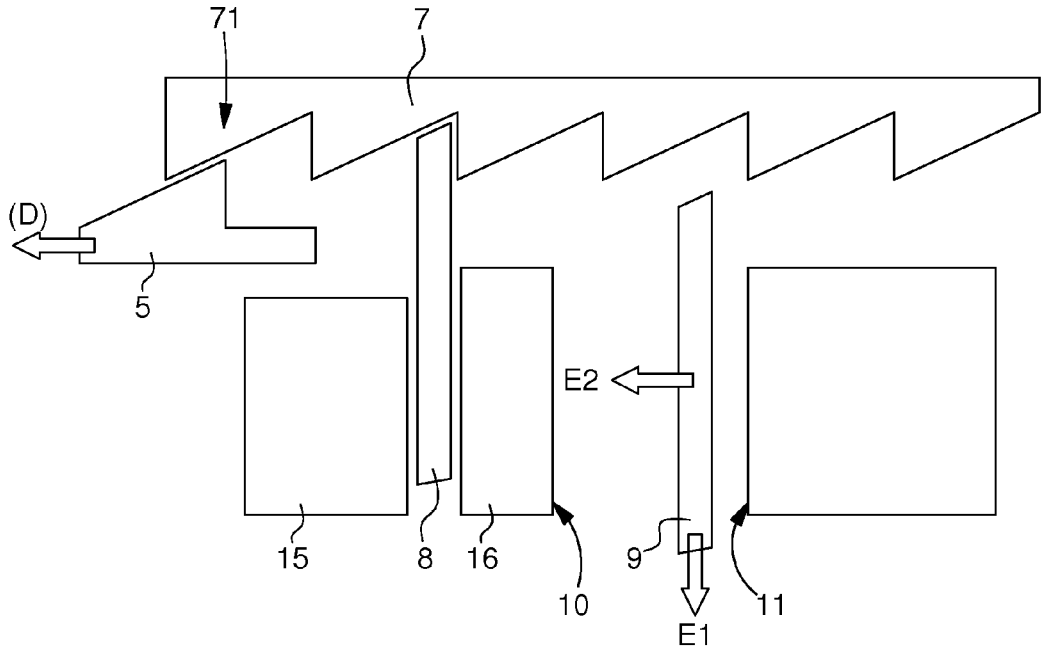
FIG. 6 illustrates a cross-section of a locking device according to a preferred embodiment of the invention after the first locking finger has been raised and during the return of the actuator and the second locking finger.

FIG. 6 illustrates the locking device after the first locking finger has been lifted and during the steps of returning the actuator (arrow D) and the second locking finger (arrow E), which had to be lowered beforehand (arrow E1) to be released from the tooth so as to allow the movement of translation in the same direction as click 5. The return steps (D) and (E2) of active click 5 and second finger 9 may be carried out independently of each other and sequentially in any order. They could, however, according to a preferred embodiment of the invention, be carried out simultaneously, for example by programming a distinct actuator (not shown in this Figure, but corresponding to reference 2 in FIG. 1) from that controlling active click 5 to act on the second finger 9 during the return movement of click 5, or even by coupling the actuator of click 5 (reference 2 in FIG. 1) to second finger 9 via a stem (not shown), so that any movement of actuator 2 in translation along the direction of the actuator oscillations (see arrow 4 in FIG. 2) and in particular the return direction (arrow D in this Figure), is accompanied by an identical movement in translation of second finger 9. This coupling would, moreover, allow the simultaneous release of click 5 and second finger 9 from the teeth in which they were respectively engaged.

Figure 7:
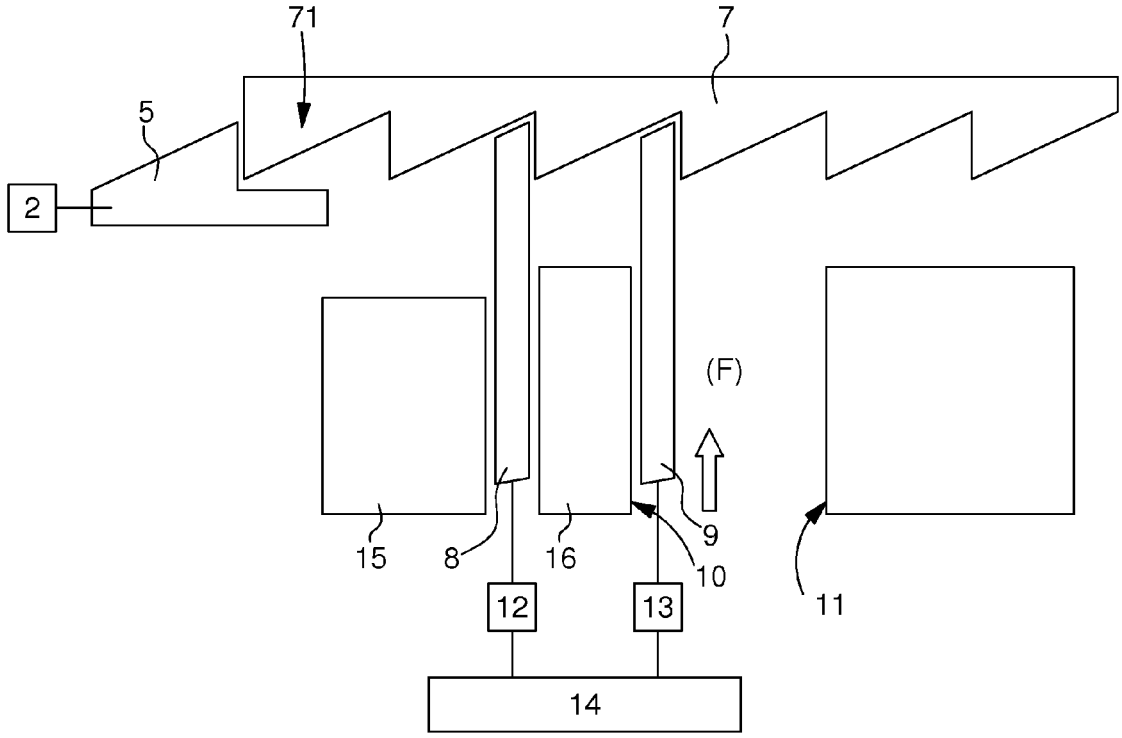
FIG. 7 illustrates a cross-section of a locking device according to a preferred embodiment of the invention, while idle at the end of a motor step.

FIG. 7 illustrates the locking device according to the invention when it is idle at the end of a motor step, i.e. once second finger 8 has returned to a stop against first stop member 10 and has been lifted into one of the teeth of toothed wheel 7 (step F, illustrated by the corresponding arrow in the Figure). It will be noted that the arrangement of the two locking fingers 8, 9 is identical to that of FIG. 2, and that of click 5 relative to fingers 8, 9. Click 5 is, however, now positioned behind tooth 71 in which it was engaged before the motor step.

Comparison of the steps described with reference to the annexed Figures reveals that, according to the preferred embodiment of the disclosed locking mechanism, the first finger 8 has a degree of freedom in translation (vertically in the Figures) so that it can be raised or lowered, and thus engaged in or released from one of the teeth of toothed wheel 7. Second finger 9 has this same degree of freedom in translation, and an additional degree of freedom between stop members 10 and 11 (horizontal in the Figures) which corresponds to the direction of the oscillations 4 of active click 5 and to the tangent of toothed wheel 7 where finger 9 meshes. It should however be observed that neither a correlation between the degrees of freedom of the two locking fingers 8, 9 is necessary to guarantee proper working of the invention, nor the direction of movement of the translations, which are not necessarily vertical and horizontal respectively. Moreover, it was already specified above that the degree of freedom for engaging and releasing the teeth could also be not in translation but potentially in rotation, for both first finger 8 and second finger 9. Any combination between the degree of freedom and the type of freedom of each finger 8, 9 is possible within the scope of the invention.

FIG. 7 also shows an electronic circuit 14, which is preferably programmable, for managing the movement sequences of locking fingers 8 and 9. This circuit 14 was added to this Figure because it corresponds to a preferred embodiment of the invention, according to which the movements of fingers 8, 9 are controlled by electric signals causing electrostatic actuators 12, 13, respectively coupled to each finger 8, 9, to move. In this Figure, motor actuator 2 has also been added to prevent any confusion with actuators 12, 13 of fingers 8, 9.

Figure 8:
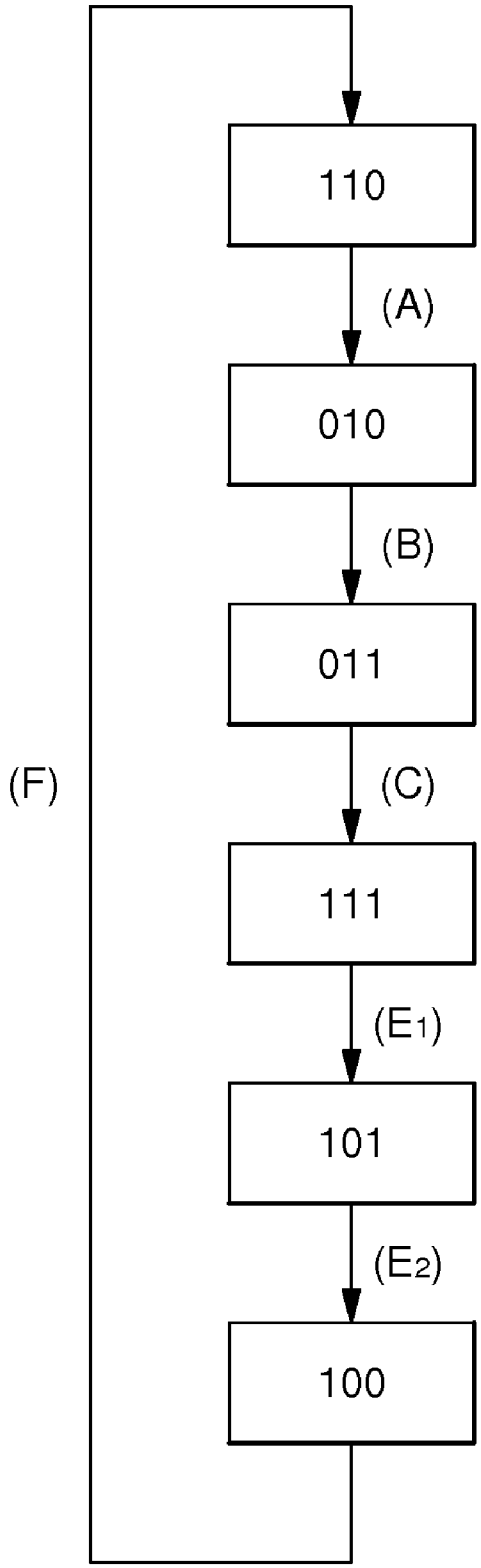
FIG. 8 illustrates a state diagram synthesising the various states of the locking device and the steps of a preferred embodiment of the locking method according to the invention.

The sequence of movements of fingers 9, 0 follows the aforementioned steps, which are synthesised in the state diagram of FIG. 8, in which the three numbers describing the state of the locking system represent the following:

$1^{st}$ number: the state of first finger 8; 0=lowered, 1=raised;

$2^{nd}$ number: the state of second finger 9: 0=lowered, 1=raised;

$3^{rd}$ number: the position of second finger 9; 0=lowered, 1=raised.

A first step A consists in lowering first finger 8, after it has been released from said toothed wheel 7, which makes the system pass from stable, "idle" or rest state 110 to a state 010 in which it is possible for the toothed wheel to rotate.

A second step B consists in driving toothed wheel 7 in rotation via active click 5 of actuator 2, which causes second locking finger 9 of stop member 10 to move in system state 010, towards the other stop member 11, which blocks the travel of the toothed wheel any further and thus brings the system into state 011.

A third step C consists in raising said first finger 8, causing it to mesh in one of the teeth of toothed wheel 7 to lock the wheel again completely, changing the system from state 011 to a stable state 111.

Step D consisting in the release and return of active click 5 of actuator 2 does not change the state of the locking system. However, step E which consists in the release and return of the second finger against the first stop member 10 can be divided into two sub-steps: E1 where the second finger is lowered changing the system from state 111 to state 101, and E2, where the system is changed from state 101 to 100. According to a preferred variant implementation of the locking method, steps D and E for the release and return of active click 5 and second finger 9 occur simultaneously.

Finally, step F consisting in raising second finger 9, which causes it to engage in one of the teeth of toothed wheel 7, returns the system to the initial state 110 called the "idle" or rest state and thus ends the incrementation cycle of one motor step.

The sequence described, which guarantees that at least one of the two fingers is always engaged in one of the teeth, either keeps the locking device in a "stable" state, i.e. in which the toothed wheel is totally immobilised (with the first finger engaged in the toothing of wheel 7), or in a "limited" state, i.e. in which the travel of the toothed wheel is limited (with the second finger 9 engaged in the toothing of wheel 7). The invention thus no longer requires the use of magnets for applying positioning torque in the idle or rest state to obtain stable states; moreover the first finger does not need to user a passive click, which is more complex to machine and consequently more expensive. Consequently, the proposed solution decreases the total cost of the locking device while improving its functions, since the angular travel of the toothed wheel is now always limited. Those skilled in the art will also observe that clicks 5 that mesh with the toothed wheel are actuated in a totally oblivious to the device and the locking method described, such that it can be applied to both electromechanical and purely mechanical timepiece trains.

According to the preferred embodiment illustrated in FIG. 7, the desired sequence is preferably obtained by electronic programming. One could, however, devise an embodiment in which at least the finger lowering and raising movements could be controlled by a cam.

Further, although, according to a preferred embodiment of the invention, the finger actuators are electrostatic, for implementation of a micromotor locking device in wristwatches, one could also imagine using hydraulic actuators for other timepiece applications. Likewise, the beveled shape of the teeth illustrated in the disclosed figures, which tends to rotate the toothed wheel anticlockwise, could be changed to a similar shape in the opposite direction or, for example, be notched to ensure that the wheel is totally locked even in the event of a shock. Indeed, this notched shape (not shown) would make it impossible for the tooth to be released via the action of forces outside the system, due to cooperation with a corresponding identical, but inverted, notched shape for the end of locking fingers 8, 9. The tooth shape illustrated in the Figures is, however, suited for meshing toothed wheels clockwise, and thus can easily be associated with a display train with hands, for example.

| | |
|---|---|
| 1 | Drive module |
| 2 | Motor actuator |
| 3 | Mobile actuator stylus |
| 4 | Direction of mobile stylus oscillations |
| 5 | Active click of the actuator |
| 6 | Passive click |
| 7 | Toothed wheel |
| 8 | First locking finger |
| 9 | Second locking finger |
| 10 | First stop member for the second locking finger |
| 11 | Second stop member for the second locking finger |
| 12 | First locking finger actuator |
| 13 | Second locking finger actuator |
| 14 | Programmable circuit for actuating the locking fingers |
| 15 | First stop element for the first locking finger |
| 16 | Second locking element for the first locking finger |
| A | Step of lowering the first locking finger |
| B | Step of driving the toothed wheel and the second locking finger |
| C | Step of raising the first locking finger |
| D | Active click return step in opposite direction to toothed wheel drive |
| E1 | Step of lowering the second locking finger |
| E2 | Second locking finger return step |
| F | Step of raising second locking finger |
| 110 | Idle or rest state of system, two fingers raised on two consecutive teeth, second finger raised against the first stop member |
| 010 | System state allowing incrementation by one tooth, first finger lowered, second finger raised against the first stop member |
| 011 | System state after incrementation by one tooth, second finger raised and against second stop member, first finger still lowered |
| 111 | Completely locked system state after incrementation by one tooth, second finger raised and against second stop member, first finger raised |
| 101 | Completely locked system state, first finger raised, second finger lowered against the second stop member |
| 100 | Completely locked system state, first finger raised, second finger lowered against the first stop member |

What is claimed is:

1. A device for locking and unitary incrementation of a drive module for a timepiece gear train, wherein the module includes an actuator fitted with an active click that cooperates with a toothed wheel, and wherein the device includes a first locking finger and a second locking finger cooperating with the toothed wheel, wherein:

the first locking finger entirely locks the rotation of the toothed wheel when the first finger is engaged in one of the teeth of the toothed wheel; and the second locking finger is arranged between a first stop member and a second stop member, and a space between the first stop member and the second stop member limits angular travel of the toothed wheel when the second locking finger is engaged in one of the teeth of the toothed wheel.

2. The device according to claim 1, wherein the maximum increment of angular travel of said toothed wheel is one tooth of said toothed wheel.

3. The device according to claim 1, wherein said first locking finger has a degree of freedom in translation, and said second locking finger has two degrees of freedom in translation.

4. The device according to claim 1, wherein said first locking finger has a degree of freedom in translation along a radius of said toothed wheel, and said second locking finger has a degree of freedom in translation along a direction of the oscillations of said active click.

5. The device according to claim 3, wherein said second locking finger has the same degree of freedom as said first locking finger and an additional degree of freedom.

6. The device according to claim 1, wherein the teeth of said toothed wheel and one end of each of the first locking finger and the second locking finger has a notched shape.

7. The device according to claim 1, wherein the first locking finger and the second locking finger are controlled by electrostatic or hydraulic actuators.

8. The device according to claim 1, including, in addition, a programmable electronic circuit for controlling the actuating signals for the first locking finger and the second locking finger.

9. The device according to claim 1, wherein said second locking finger is coupled to the actuator of said active click.

10. A method for the locking and unitary incrementation of a drive module for a timepiece gear train using the locking device of claim 1, wherein the method includes the steps of:

(A) lowering said first locking finger and releasing said toothed wheel;

(B) driving said toothed wheel in rotation via said active click of said actuator;

(C) raising said first locking finger and engaging said first locking finger in one of the teeth of said toothed wheel;

(D) releasing and returning said active click of said actuator;

(E) releasing and returning said second locking finger against said first stop member;

(F) raising said second locking finger and engaging said second locking finger in one of the teeth of said toothed wheel.

11. The method for locking and unitary incrementation of a drive module for a timepiece gear train according to claim 10, wherein said step (A) consists in a first sub-step of lowering said second locking finger and a second sub-step of returning said second locking finger against said first stop member.

12. The method according to claim 10, wherein said step (D) of releasing and returning said active click of said actuator and said step (E) of releasing and returning said second locking finger are simultaneous.

* * * * *